US011147427B2

(12) United States Patent
Yan

(10) Patent No.: US 11,147,427 B2
(45) Date of Patent: Oct. 19, 2021

(54) FULLY FLOATING CONTACT REDIRECTING DEVICE FOR CLEANING ROBOT

(71) Applicant: Jason Yan, New Taipei (TW)

(72) Inventor: Jason Yan, New Taipei (TW)

( * ) Notice: Subject to any disclaimer, the term of this patent is extended or adjusted under 35 U.S.C. 154(b) by 384 days.

(21) Appl. No.: 16/259,515

(22) Filed: Jan. 28, 2019

(65) Prior Publication Data

US 2020/0221917 A1 Jul. 16, 2020

(30) Foreign Application Priority Data

Jan. 15, 2019 (TW) ..... 108101467

(51) Int. Cl.
*A47L 11/40* (2006.01)
*A47L 9/28* (2006.01)
*A47L 11/24* (2006.01)

(52) U.S. Cl.
CPC ..... *A47L 11/4011* (2013.01); *A47L 9/2805* (2013.01); *A47L 11/4061* (2013.01); *A47L 11/24* (2013.01); *A47L 2201/04* (2013.01)

(58) Field of Classification Search
CPC .. A47L 11/24; A47L 11/4011; A47L 11/4061; A47L 2201/04; A47L 9/2805
See application file for complete search history.

(56) References Cited

U.S. PATENT DOCUMENTS

| | | | | |
|---|---|---|---|---|
| 10,093,259 | B2 * | 10/2018 | Pan | B60R 19/023 |
| 10,646,089 | B2 * | 5/2020 | Teng | B62D 57/032 |
| 2012/0065830 | A1 * | 3/2012 | Ko | A47L 9/2805 701/26 |
| 2017/0181591 | A1 * | 6/2017 | Tanaka | A47L 9/009 |
| 2017/0181593 | A1 * | 6/2017 | Ichikawa | A47L 9/0477 |
| 2017/0225638 | A1 * | 8/2017 | Pan | B60R 19/483 |
| 2020/0039079 | A1 * | 2/2020 | Brouwers | A47L 9/2889 |
| 2020/0089249 | A1 * | 3/2020 | Furuta | G05D 1/0238 |
| 2020/0205633 | A1 * | 7/2020 | Baum | G01B 11/026 |

FOREIGN PATENT DOCUMENTS

| | | | | |
|---|---|---|---|---|
| EP | 3300648 | A2 * | 4/2018 | A47L 11/4008 |
| EP | 3427627 | A2 * | 1/2019 | A47L 11/4083 |
| WO | WO-2008105634 | A1 * | 9/2008 | A47L 9/2805 |
| WO | WO-2013006005 | A2 * | 1/2013 | G01L 1/00 |

* cited by examiner

*Primary Examiner* — Marc Carlson
(74) *Attorney, Agent, or Firm* — Chun-Ming Shih; HDLS IPR Services

(57) ABSTRACT

A fully floating contact redirecting device for a cleaning robot, wherein a contact unit is floatingly disposed on a surface of a robot body in a forward direction, and at least one sensing unit is respectively disposed on opposite sides of the contact unit in a direction opposite to the forward direction. An angle at which the robot body is retracted and turned to avoid a wall or an obstacle is determined by a position where the contact unit goes into contact with the sensing unit after the contact unit touches the wall or the obstacle, thereby solving the problem of going through multiple turns to move in an obstacle-free direction and improving the cleaning efficiency of the cleaning robot.

6 Claims, 4 Drawing Sheets

Sectional view A-A'

FULLY FLOATING CONTACT REDIRECTING DEVICE FOR CLEANING ROBOT

BACKGROUND OF THE INVENTION

Field of the Invention

The present invention relates to a structure of a cleaning robot, and more particularly, to a fully floating contact redirecting device for a cleaning robot that moves the cleaning robot in the opposite direction from the wall or the obstacle according to the position of the wall or the obstacle in contact during the moving process.

Description of the Prior Art

The cleaning robot is a vacuum tool that can move autonomously and sweep the floor. When a sensing device or a top cover of the cleaning robot senses that the cleaning robot approaches or touches an obstacle or wall, it changes the direction of the cleaning robot. Therefore, the cleaning robot can perform cleaning work in a confined space or where there are quite a few obstacles (such as tables, chairs or cabinets).

At present, the sensing device or the top cover of the prior art cleaning robot is located in the moving direction of the cleaning robot. Therefore, when the sensing device or the top cover senses or touches the obstacle, the cleaning robot will retreat in the opposite direction for a short distance, turns to a fixed angle, and then keeps moving. However, when the cleaning robot enters the corner of the room or a corner surrounded by multiple obstacles, the cleaning robot must repeat the process of moving forward, retreating, and turning to move away from the corners of the room or the corners surrounded by multiple obstacles. Even when the cleaning robot touches a generally flat wall or a large obstacle, it takes multiple turns for the cleaning robot to find an obstacle-free direction, which leads to poor cleaning efficiency.

SUMMARY OF THE INVENTION

In order to solve the problems described above, it is an object of the present invention to provide a fully floating contact redirecting device for a cleaning robot that directly moves the cleaning robot in the opposite direction from the wall or the obstacle.

In order to achieve the above object, the present invention provides a fully floating contact redirecting device for a cleaning robot, which mainly comprises a top cover disposed above an outer edge of the robot body toward the moving direction of the robot body; a contact unit floatingly disposed between the robot body and the top cover; and at least two sensing units disposed on the robot body adjacent to both sides of the robot body and opposite to the moving direction of the robot body.

In an embodiment of the present invention, the robot body is connected to the top cover by a plurality of shaft units, and the contact unit is provided with a plurality of through holes at positions corresponding to the plurality of shaft units for the plurality of shaft units to go through.

In an embodiment of the present invention, the aperture of the plurality of through holes is larger than the shaft diameter of the plurality of shaft units.

In an embodiment of the present invention, the upper surface of the robot body has at least two positioning shafts extending upward, the contact unit is provided with fisheye holes corresponding to each one of the positioning shafts respectively.

In an embodiment of the present invention, a long hole is disposed at the axle center position of each floating member respectively, thereby allowing at least two fasteners to go through the long holes to be locked with the positioning shafts to fix the floating members within the fisheye holes.

In an embodiment of the present invention, the periphery and the bottom surface of each floating member have a certain gap with the inner wall surface of each fisheye hole. A washer is further disposed between each floating member and each fasteners.

In an embodiment of the present invention, the contact unit is disposed with a bump adjacent to each sensing unit respectively.

In an embodiment of the present invention, at least two tension springs are disposed between the robot body and the contact unit.

BRIEF DESCRIPTION OF THE DRAWINGS

The techniques of present invention would be more understandable from the detailed description given herein below and the accompanying figures are provided for better illustration, and thus description and figures are not limitative for present invention, and wherein.

DETAILED DESCRIPTION OF THE INVENTION

The aspect of present invention is now described with the following preferred embodiment; however, the invention is not limited thereto.

Figure 1:
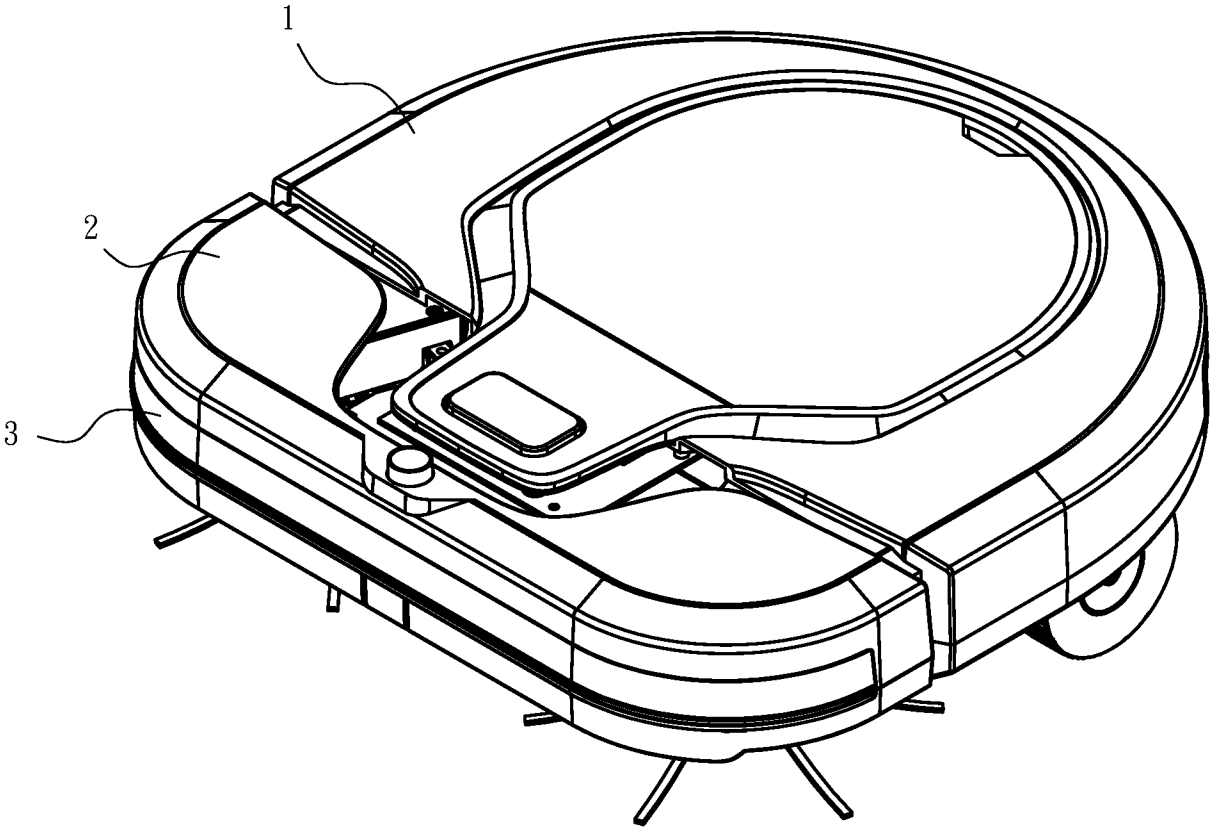
FIG. 1 illustrates a 3D view of a fully floating contact redirecting device for a cleaning robot of the present invention.
Figure 2:
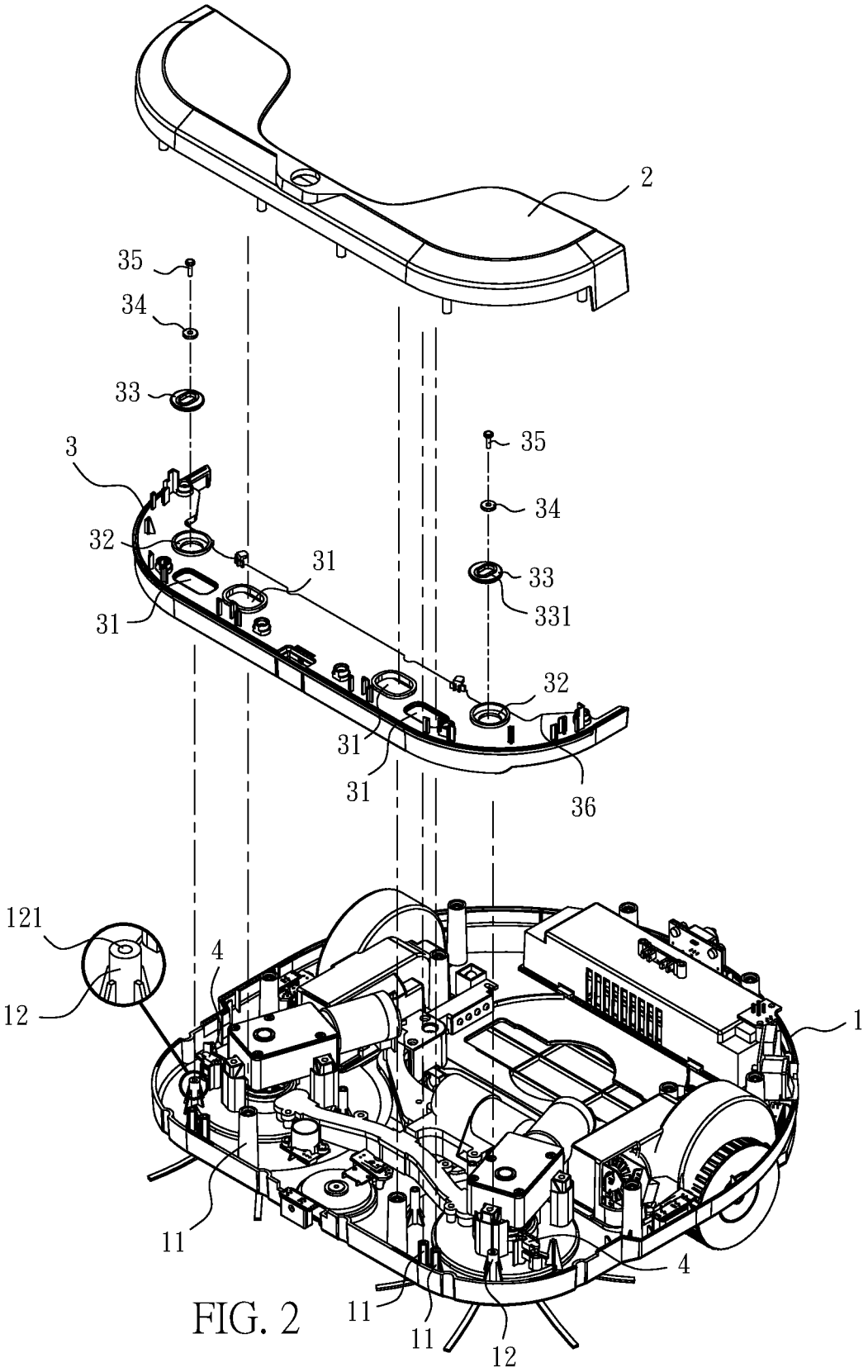
FIG. 2 illustrates an explosive view of the fully floating contact redirecting device for a cleaning robot of the present invention.
Figure 3:
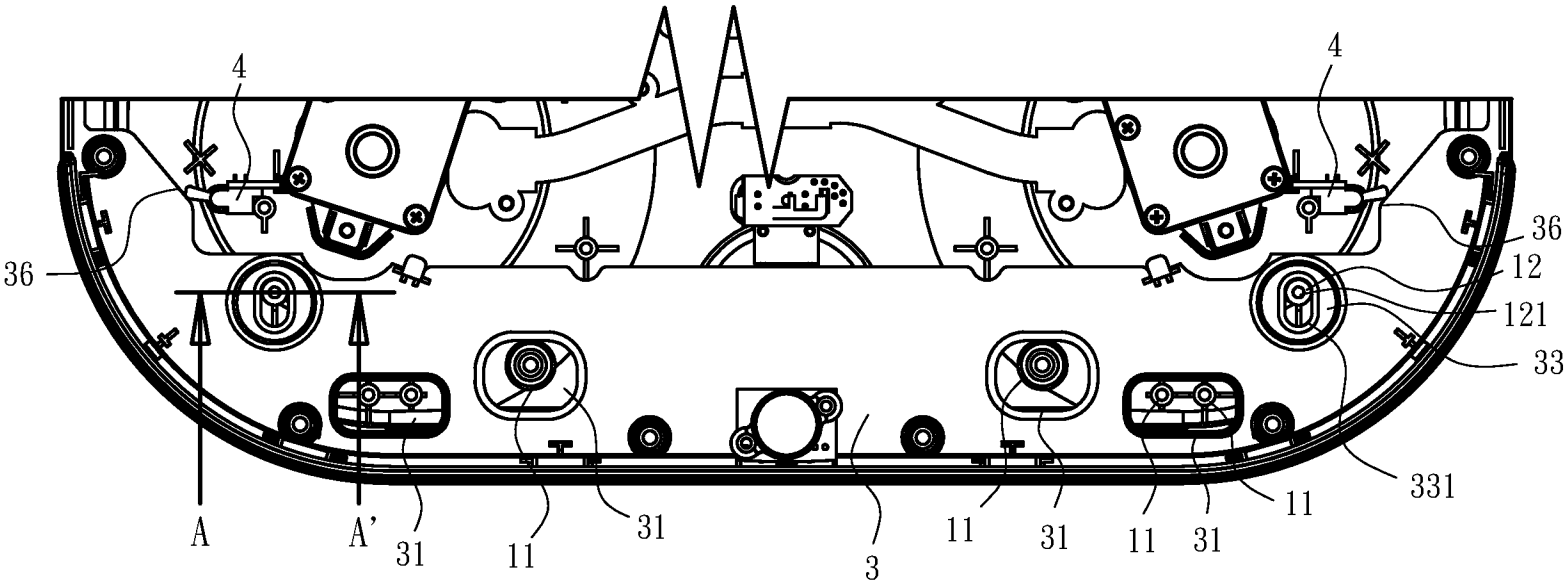
FIG. 3 illustrates a partial top view of the fully floating contact redirecting device for a cleaning robot of the present invention.
Figure 4:
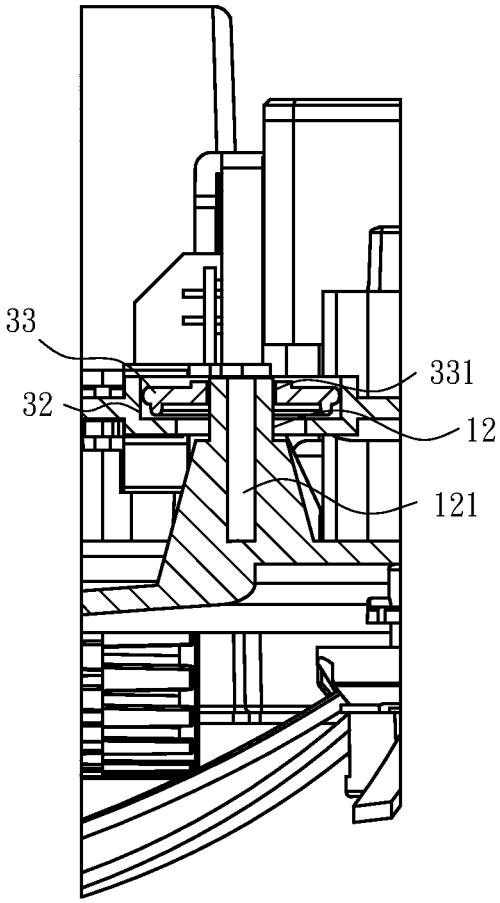
FIG. 4 illustrates a partial sectional view of the fully floating contact redirecting device for a cleaning robot of the present invention.

Please refer to FIG. 1 to 4, a fully floating contact redirecting device for a cleaning robot of the present invention mainly comprises a robot body 1, a top cover 2, a contact unit contact unit 3 and, at least two sensing units 4, the upper surface of the robot body 1 facing the edge of the robot body 1 in the moving direction is disposed with a plurality of shaft units 11 and two positioning shafts 12, wherein each one of the two positioning shafts 12 is provided with a locking hole 121 at its axle center, and the two positioning shafts are respectively disposed on two sides of the upper surface of the robot body 1.

The top cover 2 is connected to the plurality of shaft units 11 to be fixed to the robot body 1. The contact unit is disposed between the robot body 1 and the top cover 2. The sensing units 4 are disposed on opposite sides of the contact unit 3 in the opposite direction of the moving direction of the robot body 1, and the top cover 2 is disposed with an opening 121 heading toward the moving direction of the robot body 1, so as to expose the surface of the contact unit 3 to the opening 121 in the moving direction of the cleaning robot 1, therefore the contact unit 3 can touch a wall or an obstacle when the cleaning robot 1 is moving.

The contact unit 3 includes a plurality of through holes 31, two fisheye holes 32, two floating members 33, two fasteners 34, and two washers 35. The through holes 31 and the fisheye holes 32 go through the upper surface and the lower surface of the contact unit 3, and the through holes 31 are disposed at positions of the contact unit 3 corresponding to the plurality of shaft units 11 for the plurality of shaft units 11 to be connected to the top cover 2 through the through holes 31, and the fisheye holes 32 are disposed at positions of the contact unit 3 corresponding to the plurality of positioning shafts 12 of the contact unit 3 for the plurality of positioning shafts 12 to go through the fisheye holes 32. The floating members 33 are respectively disposed in the fisheye holes 32, and each floating member 33 is provided with a long holes 331 going through the upper surface and the lower surface of the floating member 33. The fasteners 34 go through the long holes 331 to be locked with the locking holes 13 of the plurality of positioning shafts 12, and the washers 35 are disposed between the fasteners 34 and the floating members 33, wherein the aperture of the through holes 31 are larger than the shaft diameter of the plurality of shaft units 11, the aperture of the fisheye holes 32 is larger than the shaft diameter of the plurality of positioning shaft 12, and the periphery and the bottom surface of each floating member 33 have a certain gap with the inner wall surface of each fisheye hole 32. Therefore, the contact unit 3 is floatingly disposed between the robot body 1 and the top cover 2.

The fully floating contact redirecting device for the cleaning robot provided by the present invention is used in the following scenario: when the robot body 1 is moving and the contact unit 3 touches an obstacle or a wall, then the contact unit 3 moves in the opposite direction from the obstacle or the wall, the direction in which the robot body 1 is retracted and the angle at which the robot body 1 turns are determined according to the position in which the contact unit 3 goes in contact with the sensing units 4, for example, when the contact unit 3 goes in contact with the sensing units 4 on both sides of the robot body 1 simultaneously, that is, the robot body 1 vertically or nearly vertically touches the obstacle or the wall during the moving process, then the robot body 1 is retreated for a certain distance in the opposite direction from the obstacle or the wall, turns to the left or right to a large angle (about 90 degrees), and then moves on to avoid repeated collisions with the same obstacle or wall. When the contact unit 3 only goes into contact with one of the sensing units 4, it means that the robot body 1 is touching the obstacle or the wall on the left or right side during the moving process, then the robot body 1 is retreated in the opposite direction from the obstacle or the wall by a certain distance, wherein an angle between the moving direction of the robot body 1 and the obstacle or the wall is determined according to the position where the sensing unit 4 goes into contact with the contact unit 3, and then the robot body 1 is turned to the direction parallel to the obstacle or the wall. After that, the robot body 1 is driven to move on to perform the cleaning work.

As described above, the fully floating contact redirecting device for the cleaning robot provided by the present invention can determine the direction of the wall or obstacle according to the contact between the sensing units 4 and the contact unit 3 floatingly disposed on the robot body 1. Then the robot body 1 is driven to make a large or a small angle turn to avoid touching the walls or obstacles, in contrast to the repeated vertical detection and fixed angle turning structure of prior art cleaning robot, the fully floating contact redirecting device for the cleaning robot can reduce the process of repeatedly moving forward, retreating, and turning to move away from the corners of the room or the corners surrounded by the obstacles, thereby improving the cleaning efficiency.

Besides, as in the embodiment of the fully floating contact redirecting device for a cleaning robot of the present invention, the contact unit is disposed with a bump 36 adjacent to each sensing unit 4 respectively, when the contact unit 3 moves, the bumps 36 go into contact with the sensing units 4 respectively. In addition, as in the embodiment of the fully floating contact redirecting device for a cleaning robot of the present invention, at least two tension springs (not shown in figures) are disposed between the robot body 1 and the contact unit 3, and when the contact unit 3 moves and touches the sensing units 4, the contact unit is pulled back into the original position by the tension springs.

What is claimed is:

1. A fully floating contact redirecting device for a cleaning robot mainly comprising: a robot body; a top cover disposed above an outer edge of the robot body toward a moving direction of the robot body; a contact unit floatingly disposed between the robot body and the top cover; at least two sensing units disposed on the robot body adjacent to both sides of the robot body and close to the contact unit, when the robot body moves and goes into contact with a wall or an obstacle, the contact unit is driven to move in an opposite direction from the wall or the obstacle to simultaneously go into contact with the sensing units or one of the sensing units, thereby determining a direction of the wall or the obstacle and driving the robot body to move in the opposite direction from the wall or the obstacle; wherein the robot body is connected to the top cover by a plurality of shaft units, and the contact unit is provided with a plurality of through holes at positions corresponding to the plurality of shaft units respectively for the plurality of shaft units to go through, and an aperture of each through hole is larger than a shaft diameter of each shaft unit; wherein an upper surface of the robot body has at least two positioning shafts extending upward, and the contact unit is provided with a fisheye hole corresponding to each positioning shaft; wherein an aperture of the fisheye hole is larger than a shaft diameter of the positioning shaft, and the contact unit is provided with a floating member in the fisheye hole; wherein a long hole is disposed at an axle center position of the floating member, so as to allow a fastener to go through the long hole to be locked with the positioning shaft to fix the floating member within the fisheye hole; wherein the aperture is rectangle in shape and a long side of the aperture is perpendicular to a longest edge of the long hole.

2. The fully floating contact redirecting device for a cleaning robot as claimed in claim 1, wherein the positioning shaft has a locking hole disposed at an axle center of the positioning shaft for the fastener to be locked with the positioning shaft.

3. The fully floating contact redirecting device for a cleaning robot as claimed in claim 2, wherein a periphery and a bottom surface of the floating member have a certain gap with an inner wall surface of the fisheye hole.

4. The fully floating contact redirecting device for a cleaning robot as claimed in claim 2, wherein a washer is further disposed between the floating member and the fastener.

5. The fully floating contact redirecting device for a cleaning robot as claimed in claim 1, wherein the contact unit is disposed with a bump adjacent to each sensing unit, when the contact unit moves, the bump goes into contact with the sensing unit.

6. The fully floating contact redirecting device for a cleaning robot as claimed in claim 1 further comprising at least two tension springs, wherein two ends of the tension spring are respectively connected to the robot body and the contact unit, and when the contact unit moves and touches the sensing units, the contact unit is pulled back into an original position by the tension springs.

* * * * *